US008307917B2

(12) United States Patent
Kotsonis et al.

(10) Patent No.: US 8,307,917 B2
(45) Date of Patent: Nov. 13, 2012

(54) DOWNHOLE INJECTOR SYSTEM FOR CT AND WIRELINE DRILLING

(75) Inventors: Spyro Kotsonis, Missouri City, TX (US); Eric Lavrut, Yokohama (JP)

(73) Assignee: Schlumberger Technology Corporation, Sugar Land, TX (US)

( * ) Notice: Subject to any disclaimer, the term of this patent is extended or adjusted under 35 U.S.C. 154(b) by 362 days.

(21) Appl. No.: 12/519,690

(22) PCT Filed: Dec. 12, 2007

(86) PCT No.: PCT/EP2007/010957

§ 371 (c)(1), (2), (4) Date: Jan. 7, 2010

(87) PCT Pub. No.: WO2008/077500

PCT Pub. Date: Jul. 3, 2008

(65) Prior Publication Data

US 2010/0108329 A1 May 6, 2010

(30) Foreign Application Priority Data

Dec. 27, 2006 (EP) ..... 06127221

(51) Int. Cl.
*E21B 3/00* (2006.01)

(52) U.S. Cl. ..... 175/94; 166/77.2; 166/385

(58) Field of Classification Search ..... 166/77.1–77.3, 166/385; 175/94, 97–99
See application file for complete search history.

(56) References Cited

U.S. PATENT DOCUMENTS 4,252,190 A 2/1981 Jageler et al.
4,365,676 A * 12/1982 Boyadjieff et al. ..... 175/61
(Continued)

FOREIGN PATENT DOCUMENTS

DE 3116715 11/1982
(Continued)

OTHER PUBLICATIONS

Entries for "riser" and "measurements-while-drilling" from the Schlumberger Oilfield Glossary, accessed via www.archive.org.*

*Primary Examiner* — William P Neuder
*Assistant Examiner* — Blake Michener
(74) *Attorney, Agent, or Firm* — Stephanie Chi; Darla Fonseca; Jody DeStefanis

(57) ABSTRACT

An apparatus for moving tubing through a borehole is disclosed. The apparatus includes a surface injector assembly and a downhole injector assembly with a driving mechanism to move the tubing through the borehole, an anchoring system for securing the downhole injector assembly downhole to a cased portion of a borehole wall and connections for receiving a power supply form the surface. A method of moving tubing through a borehole is also disclosed. The method involves attaching a downhole injector assembly to a cased portion of a borehole wall sufficiently downhole such that the downhole injector assembly can supply weight to a drilling assembly, and injecting tubing through the borehole using the downhole injector assembly.

15 Claims, 5 Drawing Sheets

U.S. PATENT DOCUMENTS

| | | | | |
|---|---|---|---|---|
| 6,286,592 | B1 * | 9/2001 | Moore et al. | 166/50 |
| 7,059,417 | B2 * | 6/2006 | Moore et al. | 166/381 |
| 7,114,571 | B2 * | 10/2006 | Gatherar et al. | 166/367 |
| 2004/0050589 | A1 * | 3/2004 | Head | 175/57 |
| 2004/0159427 | A1 * | 8/2004 | Austbo et al. | 166/77.3 |
| 2005/0034874 | A1 * | 2/2005 | Guerrero et al. | 166/380 |
| 2005/0224224 | A1 | 10/2005 | Martin et al. | |
| 2005/0263325 | A1 * | 12/2005 | Doering et al. | 175/106 |
| 2006/0124314 | A1 * | 6/2006 | Haheim et al. | 166/368 |
| 2008/0202769 | A1 * | 8/2008 | Dupree et al. | 166/382 |
| 2008/0277166 | A1 * | 11/2008 | Orban et al. | 175/76 |
| 2009/0078424 | A1 * | 3/2009 | Carossino et al. | 166/341 |

FOREIGN PATENT DOCUMENTS

| | | |
|---|---|---|
| FR | 2726320 | 5/1996 |
| GB | 2294674 | 5/1996 |
| GB | 2330162 | 4/1999 |
| GB | 2398308 | 8/2004 |
| WO | 2004072437 | 8/2004 |

* cited by examiner

DOWNHOLE INJECTOR SYSTEM FOR CT AND WIRELINE DRILLING

TECHNICAL FIELD

This invention relates to apparatus and methods for moving tubulars or Coiled Tubing (CT) through a borehole such as oil, water, gas or similar. In particular the invention relates to providing a downhole apparatus for independently moving tubulars or CT along a borehole.

BACKGROUND ART

In conventional drilling a drill bit is attached to a bottom hole assembly that is connected to a drill string. Drilling is achieved by rotating the drillstring at the surface or by using a downhole motor which causes the drill bit to rotate, and together with the weight applied to the bit allows the drill to progress through the formation.

When drilling vertical wells gravity is often sufficient to provide weight to allow the drill to progress. However when lateral drilling is carried out, weight needs to be supplied to the drilling assembly downhole to progress the drilling forward.

During coil tubing (CT) and coil tubing drilling (CTD) operations, tubing is injected from the surface and pushed down through the well via an injector assembly located on the surface. Since the tubing is pushed the tubing tends to assume a helical shape in the well and eventually lock-up in the well. As a result any additional force at the surface does not translate to movement at the end of the CT, but is instead lost in friction along the length of the CT. Therefore there is a limit to the depth that the CT can reach. For example a 1.5" diameter CT can only be pushed 3000-4000 ft laterally.

Current methods of supplying weight to the drilling assembly and conveying a drilling assembly along a well downhole include using tractor/crawler devices to increase the distance the CT could reach compared to if it was only pushed from the surface. Other methods include vibrators and lubrication agents (beads etc) in the mud; all aiming at decreasing the friction coefficient between the CT and well and thus increase the reach—or final depth the CT can achieve.

WO 2004072437 describes an apparatus that anchors to the formation when it is drilling and pulls the circulation hose and wireline cable behind it as it moves forward. A drive unit provides the weight on bit to move the drill assembly away from anchored portion and thereby drive the drill assembly forward.

These completely autonomous systems need to create the drilling torque, weight and advancement, and comprise a circulation means if required to convey the cuttings to the parent well or surface. A problem with these types of tools is any part of the tool that travels through a lateral section of a borehole is required to travel through a curve without getting stuck and must also fit in the hole drilled by the bit. The anchoring mechanisms must contend with varying formation strengths and characteristics making for more complex designs for the units. Therefore it would be beneficial if one of these functions could be removed from the cable and instead performed independently from the cable and drilling tool in the parent (vertical)—and usually much larger—well. This would enable the tool in the lateral well to be simpler, shorter and consequently cheaper and the overall LIH (Lost in Hole) cost of the operation would also decrease.

The object of the invention is to increase the lateral reach of a CT without the need to anchor the tubing and drilling tool in the anisotropic and sometimes fragile formation. In particular a downhole injector assembly is provided to supply weight downhole to a drilling assembly and to move a cable through a borehole.

DISCLOSURE OF THE INVENTION

Accordingly one aspect of the invention comprises an apparatus for moving tubing through a borehole comprising:
an injector assembly with a driving mechanism to move the tubing through the borehole;
wherein the apparatus comprises an anchoring system for securing the injector assembly downhole to a cased portion of a borehole wall and connections for receiving a power supply from the surface. The apparatus increases the axial push force on the tubing thereby increasing the lateral reach of the tubing and allowing drilling to occur further along a lateral well.

Preferably the driving mechanism is adjustable so that the size of the space in the downhole injector assembly through which the tubing moves can be varied. This will allow tubing with different diameters to be injected through the assembly and larger tools to be run through without interfering with the injector assembly before the tubing injection operation starts.

The driving mechanism can comprise of a chain assembly that grips the tubing, and a drive motor that turns the chain assembly to move the tubing through the injector assembly.

Preferably the driving mechanism can operate in two directions. This occurs by the drive motor being able to turn the chain wheels in either direction. This allows the injector assembly to both push down and pull up the coiled tubing through the borehole.

A second aspect of the invention comprises a system for conveying tubing along a borehole comprising:
an injector assembly with a driving mechanism secured to the cased wall of the borehole and coiled tubing inserted down the borehole through the injector assembly.

A further aspect of the invention comprises a method for moving tubing through a borehole comprising:
inserting an injector assembly with a driving mechanism downhole;
attaching the assembly to the cased portion of the borehole wall; and
injecting the tubing through the borehole using the downhole injector.

The injector assembly is locked to the inner wall of the well in the main wall of the borehole, so that the injector assembly stays in one location as the tubing is conveyed through it.

Injecting the tubing along the borehole can comprise of pushing the tubing down the borehole to convey the tubing further along the well or comprises pulling the tubing up the borehole to remove the tubing from the well.

The tubing and down hole injector are inserted into the borehole simultaneously or alternatively the method comprises inserting the injector assembly into the borehole prior to inserting the tubing assembly into the borehole.

The injector assembly can be powered by a power line or lines run down from the surface. The power lines can run parallel to the tubing and may be either electric or hydraulic or a combination thereof.

Preferably the downhole injector is positioned above a curve in the vertical portion in the borehole.

Preferably a drilling assembly is attached to the bottom end of the tubing. Alternatively logging equipment may be attached at the bottom end of the tubing instead of or above the drilling assembly.

Preferably the method is carried out using the apparatus described above.

MODE(S) FOR CARRYING OUT THE INVENTION

Figure 1:
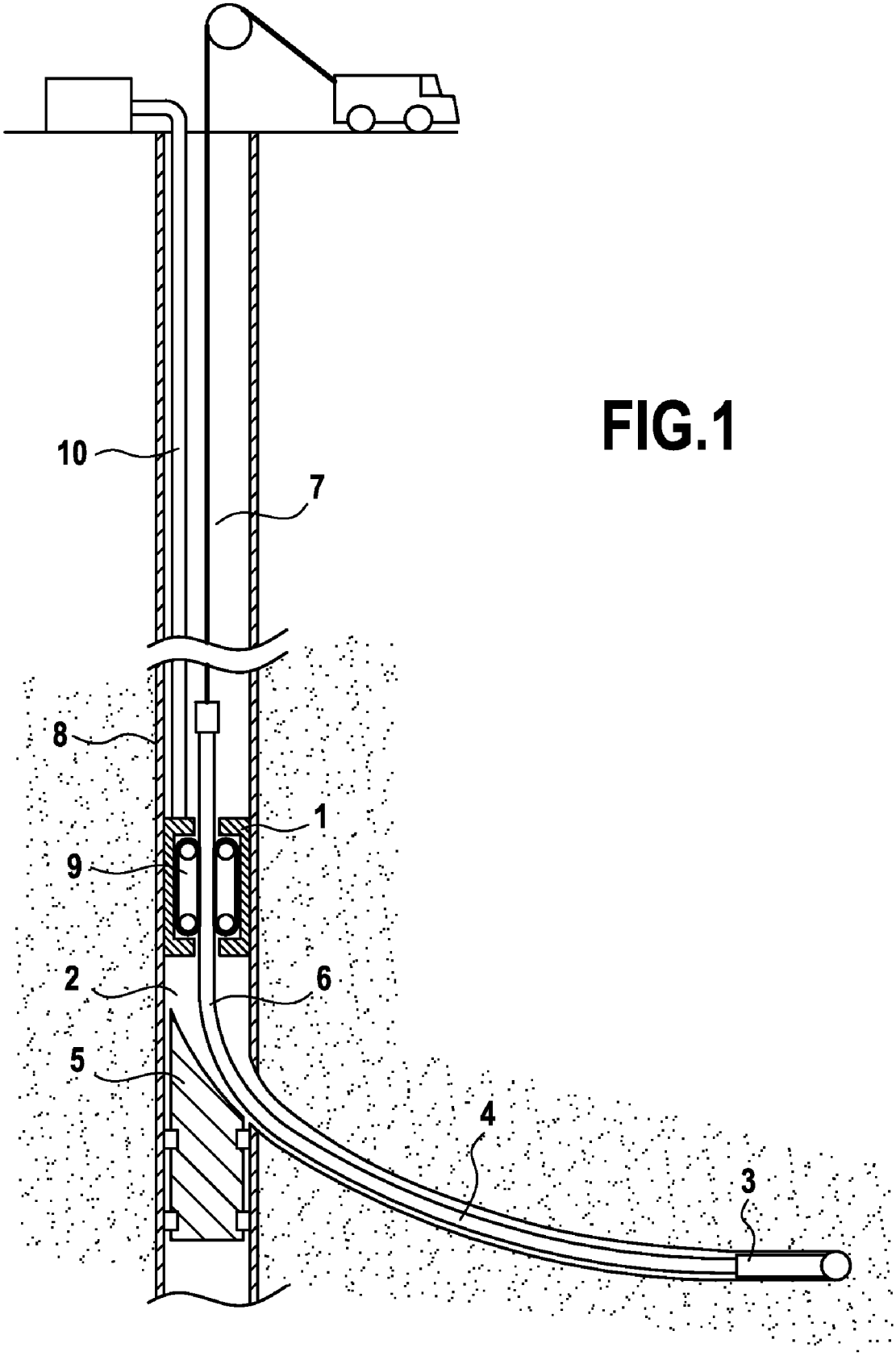
FIG. 1 depicts a proposed arrangement for use as a CT drilling injector to apply WOB

Referring to FIG. 1 a drilling operation is shown using a downhole injector assembly 1 located in the vertical portion of the main well 2 for supply a drilling assembly 3 with WOB to drill a lateral well 4 extending away from the main well 2. A deflector 5 is positioned in the vertical portion of the wall to guide the tubing 6 into a lateral portion of the well. The CT can extend all the way to the surface reel, or alternatively, a wireline cable 7 extends from the surface down the well through to tubing 6. A drilling assembly 3 is located at the bottom end of the tubing 6. The tubing 6 supplies the drilling assembly with its power and drilling fluid. The downhole injector assembly 1 is anchored to the casing 8 of the main well 2 and comprises a driving mechanism 9 to convey the tubing 6 through the well. The injector is powered using a separate electric or hydraulic line cable 10 running from the surface to the injector assembly 1. The injector assembly 1 provides WOB to the drilling assembly to move the drilling assembly forward as it drills. It can also react torque generated during the drilling process by the drilling assembly.

In this operation a fixed length of coiled tubing (CT) is pushed in the well, its length is calculated by allowing the end of the CT to still be in the parent well and past the downhole injector after the desired lateral length has been drilled.

This configuration allows WOB to be applied closer to a drilling assembly, and therefore better control of the drilling parameters can be obtained. Locating the downhole injection assembly in the main well close to where the lateral well deviates from the main well means that the operator does not have to contend with guiding the injector assembly around a curve in the well and a more simplified drilling assembly can be used but still having WOB applied close to the drilling assembly.

Figure 2:
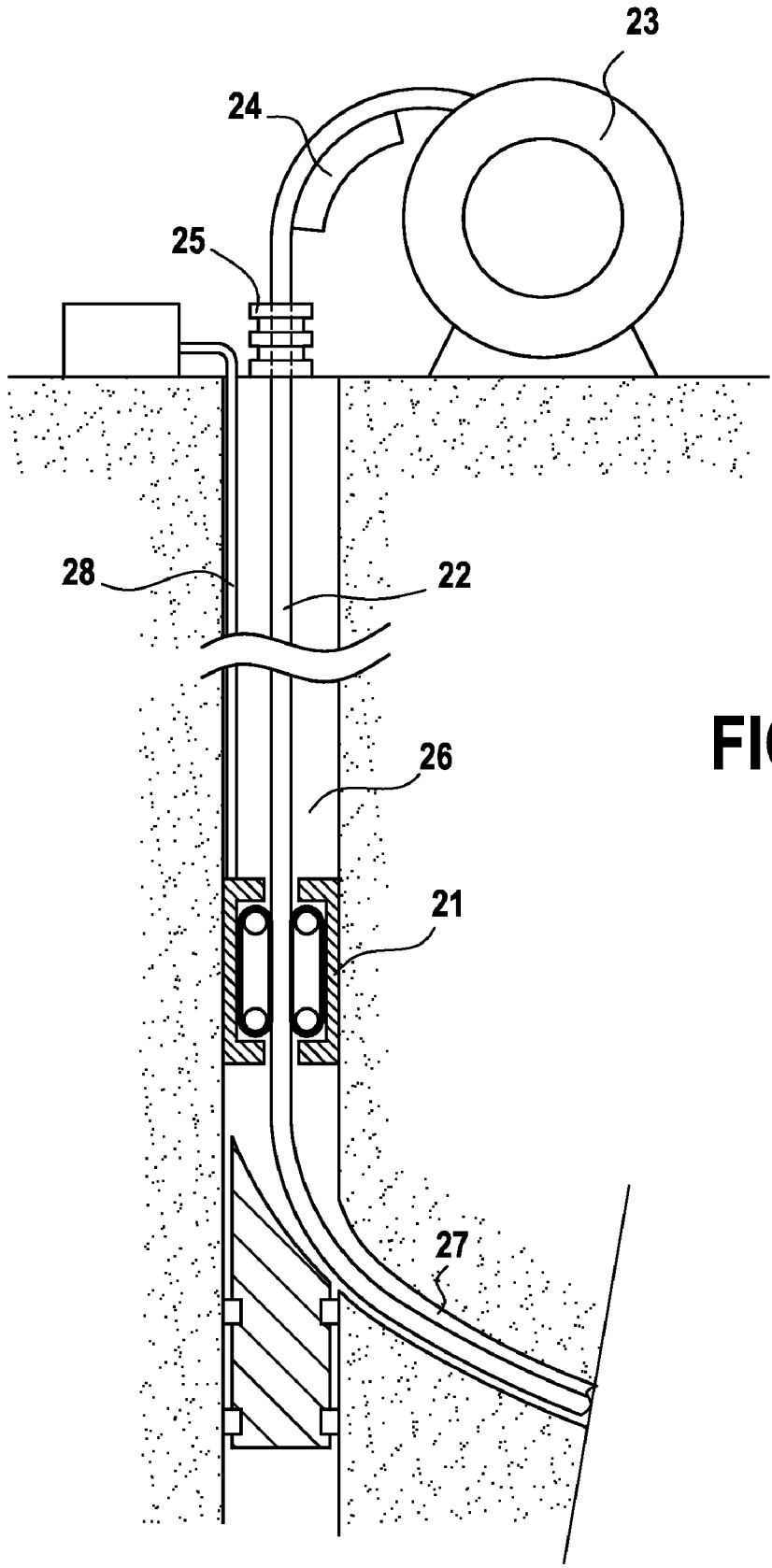
FIG. 2 depicts a proposed arrangement to increase the reach of a CT downhole

Referring to FIG. 2 according to one embodiment of the invention the downhole injector assembly can be used to increase the reach of coiled tubing (CT) 22 down a well. CT is released from the CT drum 23 located on the surface. A gooseneck 24 straightens and guides the CT into a surface CT injector 25, which can be of any type known in the art, see for example WO2006103464. The surface CT injector 25 pushes the CT down the well transferring the CT to the downhole injector 21. The downhole injector assembly is secured to the wall of the vertical portion of the main well 26 and pushes the CT down into the lateral well 27. The downhole injector is powered by a power line 28 run down the side of the well from the surface.

Using this method the reach of the CT can be substantially increased before lock-up occurs, compared to what can be achieved using only a surface injector. The end of the tubing could have logging apparatus or a drilling assembly attached at the bottom end of the tubing.

Figure 3:
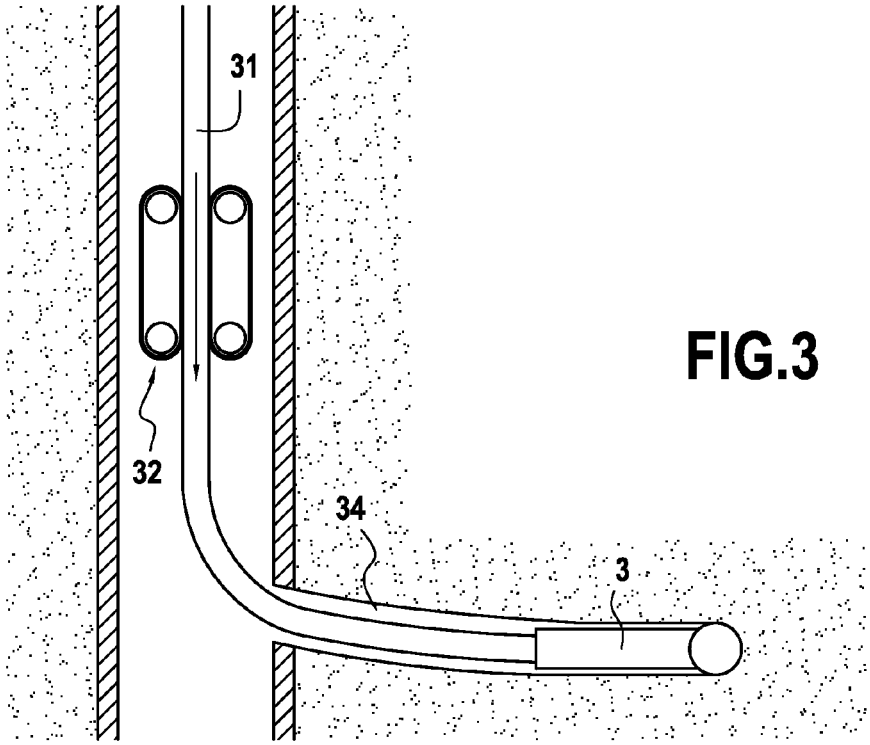
FIG. 3 depicts the start of the injection operation
Figure 4:
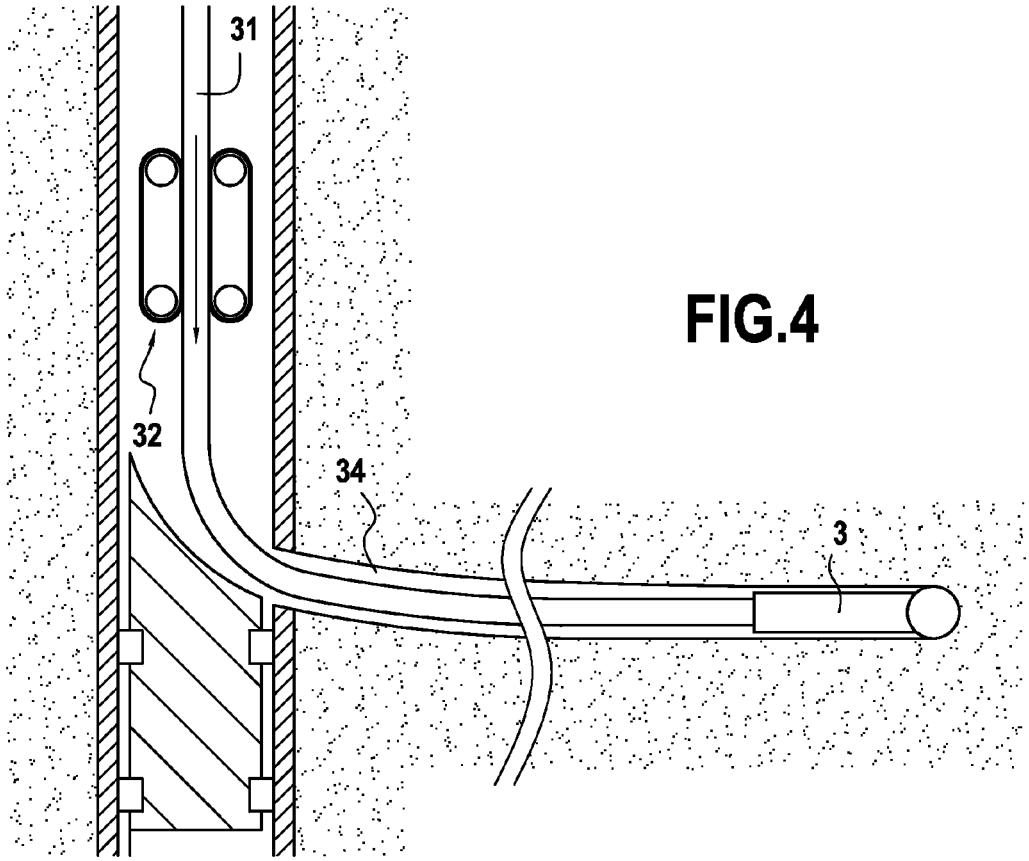
FIG. 4 depicts the end of the injection operation

FIG. 3 shows the start of the injection phase and FIG. 4 shows the end of the injection phase for inserting tubing 31 down a well. At the start of the operation most of the tubing is above the downhole injector assembly 32 (FIG. 3). Once the drilling assembly 33 starts drilling more tubing or wireline cable is released from the surface and the downhole injector 32 feeds the tubing 31 down into the lateral well 34 until the desired length of the well is reached (FIG. 4).

Figure 5:
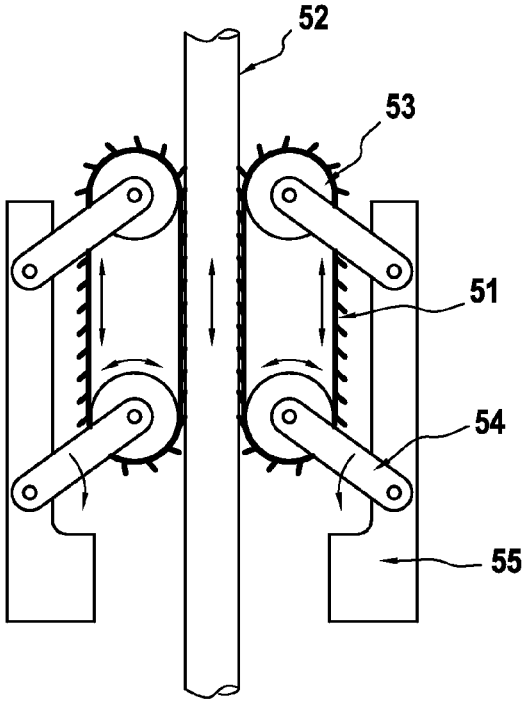
FIG. 5 depicts an example of a downhole injector assembly

FIG. 5 exemplifies a proposed embodiment of the driving mechanism of the downhole injector of the invention. The driving mechanism consists of at least one pair of opposing closed chains 51 that are forced into contact with the CT 52 as the tubing is feed through the borehole. A drive motor rotates the chain wheels 53 which the chain loops 51 surround via the axles 54. The chains grip the tubing 52 and pull more of the tubing into the well or help push the tubing back out of the well. The motor can be operated in two directions to turn the chain wheels 53 and the closed chains 51 in either direction. Each wheel 53 rotates around the end of an axle 54 that rotate around a fixed axis point on the housing 55 of the injector assembly. This allows the distance between wheels 53 and chains 51 on opposite sides of the injector assembly to be altered and therefore allow CT 52 with differing diameters to be injected and to also open up enough space between the wheels 53 to allow larger apparatus, such as drilling assembly or logging tools, to run through the injector before the CT injection operation starts.

Figure 6:
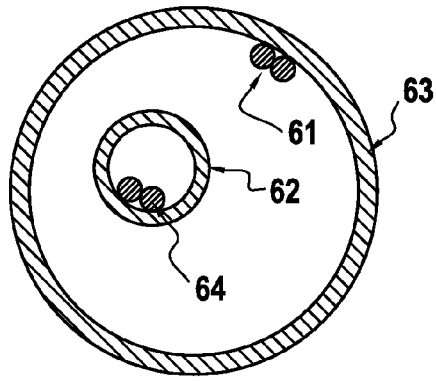
FIG. 6 depicts an example of the cross-section through the casing above the injector.
Figure 7A:
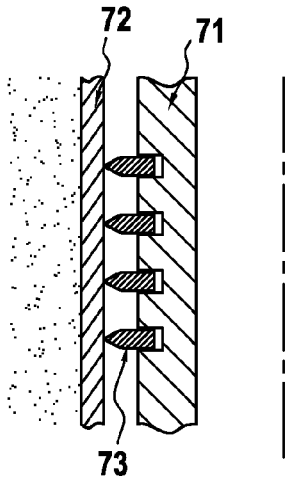
FIG. 7 depicts various means of anchoring the injector system to the borehole wall.
Figure 7B:
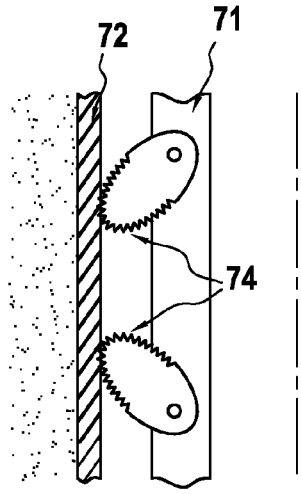
Figure 7C:
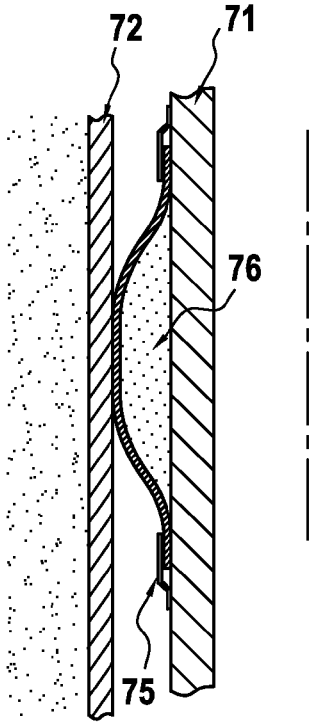
Figure 7D:
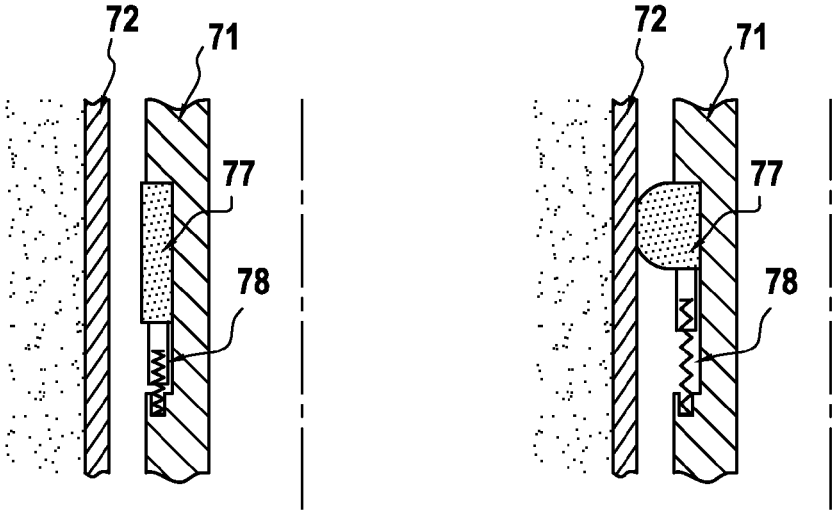

FIG. 6 shows an example cross-section through the upper casing of the well (above the injector) and a possible disposition of the power cables. Power and communication lines 61 run parallel to the coiled tubing 62 down the side of the casing 63, to the downhole injector. Theses lines may be either electric, hydraulic or a combination thereof. Communication and/or power means 64 to the drilling assembly at the end of the CT can run down the inside the injected CT 62.

The anchoring system allows the downhole injector to be secured to a particular portion down the borehole. It prevents the downhole injector system from displacing axially up or down the borehole was it is locked in place. The anchoring system can comprise locking members positioned on the outer surface of the injector assembly. Various mechanisms can be used to anchor the injector. The locking members can be operated by a drive unit which extends the locking members against the wall of the borehole. When the injector assembly is to be moved the locking members are unlocked so that the assembly can be moved further up or down the borehole. GB 2398308 describes an anchoring system with a locking mechanism for moving a downhole tool through a borehole.

FIG. 7 shows various means of anchoring the injector assembly in the casing. FIG. 7(*a*) shows a downhole injector assembly 71 attached to the casing 72 of a borehole by hydraulically activated indenters. Once at the required position of the borehole the indenters 73 are extended so that they can penetrate the formation and hold the injector assembly in place. FIG. 7(*b*) shows the down hole injector assembly locked in place via dual cams 74, which are locked in both directions via a geared electric motor. FIG. 7(*c*) shows an anchoring assembly comprising a hydraulic packer. The downhole injector assembly is anchored to the casing 72 of the borehole at via an inflatable packer. At its desired position the reinforced elastomer 75 is filled with pressurized oil 76 so that the elastomer 75 expands and forcing itself against the casing 72 of the borehole to hold the downhole injector in place. FIG. 7(*d*) shows an anchoring assembly comprising a rubber packer. When the injector assembly is run down the borehole the elastomer ring is maintained within the assembly. Once the assembly has reached the desired positions the hydraulically or electrically actuated piston 78 is activated. This causes the elastomer ring 77 to be squeezed and expand radially outwards such that it contacts the casing of the borehole and maintains the downhole injector assembly in place.

Many of these anchoring systems are currently used in the industry to tractor, crawl, or lock downhole components in an axial sense against a cased-hole section of the well.

Other changes may be made without departing from the scope of the invention.

The invention claimed is:

1. An apparatus for moving tubing through a borehole comprising: a surface injector assembly; and, a downhole injector assembly with a driving mechanism to move the tubing through the borehole and to supply weight downhole to a drilling assembly; wherein the apparatus comprises an anchoring system for securing the downhole injector assembly downhole to a cased portion of a borehole wall and connections for receiving a power supply from the surface, wherein the downhole injector assembly has a sized space through which the tubing moves and the driving mechanism is adjustable so that the size of the space in the downhole injector assembly through which the tubing moves can be varied.

2. An apparatus according to claim 1, wherein the driving mechanism comprises a chain assembly that in use can contact the tubing and drive motors to turn a plurality of chain wheels.

3. An apparatus according to claim 1, wherein the driving mechanism can operate in two directions.

4. A system for conveying tubing along a borehole comprising: a surface injector assembly; a downhole injector assembly with a driving mechanism, wherein the downhole injector assembly is secured sufficiently downhole to a cased wall of the borehole to supply weight downhole to a drilling assembly; and, coiled tubing inserted down the borehole through the injector assemblies, wherein the downhole injector assembly has a sized space through which the tubing moves and the driving mechanism is adjustable so that the size of the space in the downhole injector assembly through which the tubing moves can be varied.

5. A method for moving tubing through a borehole comprising: inserting a downhole injector assembly with a driving mechanism sufficiently downhole such that the downhole injector assembly can supply weight on bit to drill a lateral well extending away from a main well; attaching the downhole injector assembly to a cased portion of the borehole wall; and injecting the tubing through the borehole using a surface injector and the downhole injector, wherein the downhole injector assembly has a sized space through which the tubing moves and the driving mechanism is adjustable so that the size of the space in the downhole injector assembly through which the tubing moves can be varied.

6. A method according to claim 5 comprising locking the downhole injector assembly to the wall of the borehole.

7. A method according to claim 5, wherein injecting the tubing through the borehole comprises pushing the tubing down the borehole to convey the tubing further along the well.

8. A method according to claim 5, wherein injecting the tubing through the borehole comprises pulling the tubing up the borehole to remove the tubing from the well.

9. A method according to claim 5, further comprising guiding the tubing into the surface injector, thereafter guiding the tubing into a downhole injector assembly, wherein the tubing and downhole injector are thereafter together lowered through the borehole.

10. A method according to claim 5, comprising inserting the downhole injector assembly into the borehole prior to inserting the tubing assembly into the borehole.

11. A method according to claim 5, wherein the downhole injector is positioned above a curve in a vertical portion of the borehole.

12. A method according to claim 5, wherein a drilling assembly is attached to a bottom end of the tubing.

13. A method according to claim 5, wherein logging equipment is attached to a bottom end of the tubing.

14. A method according to claim 5, further comprising guiding the tubing through the surface injector assembly, which pushes the tubing down the well transferring the tubing to the downhole injector.

15. A method according to claim 14, wherein the borehole has a vertical portion and a lateral portion, and the method further comprises locating the downhole injector assembly in the vertical portion of the borehole near the lateral portion of the borehole, and injecting the tubing comprises injecting the tubing into at least the lateral portion of the borehole.

* * * * *